United States Patent [19]

Middleton

[11] 4,003,425

[45] Jan. 18, 1977

[54] METHOD OF AND MEANS FOR OBTAINING WHITE CAST IRON

[75] Inventor: William Robert Middleton, Harrogate, England

[73] Assignee: The British Cast Iron Research Assoc., Birmingham, England

[22] Filed: Feb. 10, 1976

[21] Appl. No.: 656,961

[30] Foreign Application Priority Data

Feb. 11, 1975 United Kingdom ..... 5699/75

[52] U.S. Cl. ..... 164/58; 164/57; 164/74; 164/138; 164/361; 106/38.27; 164/349

[51] Int. Cl.[2] ..... B22D 27/18; B22D 27/20

[58] Field of Search ..... 164/14, 57, 58, 72, 164/74, 138, 349, 361; 427/134, 133; 106/38.22, 38.27; 75/130 R

[56] References Cited

UNITED STATES PATENTS

| | | | |
|---|---|---|---|
| 2,250,488 | 7/1941 | Lorig et al. | 164/138 X |
| 3,116,522 | 1/1964 | Taylor | 164/361 |
| 3,243,397 | 3/1966 | Herkimer et al. | 164/72 X |
| 3,282,683 | 11/1966 | Moore | 75/130 R |

FOREIGN PATENTS OR APPLICATIONS

| | | | |
|---|---|---|---|
| 1,483,564 | 3/1969 | Germany | 164/72 |

*Primary Examiner*—Ronald J. Shore
*Attorney, Agent, or Firm*—Scrivener Parker Scrivener and Clarke

[57] ABSTRACT

In an iron molding process and in a mold for carrying out the process, in which the mold is at least locally coated with tellurium or bismuth to promote the production of a white iron structure there is included in the coating a water-bearing substance in which the water is loosely chemically combined tightly enough so that it withstands the heat involved in drying of the mold but is liberated on contact with the molten iron.

10 Claims, No Drawings

METHOD OF AND MEANS FOR OBTAINING WHITE CAST IRON

This invention relates to a method of obtaining a white cast iron structure using coated molds. There are occasions when it is desirable to cause at least a portion of an iron casting, of a composition that would otherwise be expected to solidify with a more or less graphite structure, to solidify with a wholly or partially white structure, i.e. with the carbon present substantially wholly in combined form instead of as free graphite. For example, although white cast iron is very hard and brittle, and almost unmachineable, it is useful to have local regions of white iron structure at particular points in a casting which, in use, are going to be exposed to severe wear. This is commonly achieved by pouring the metal into a mold which has a metal chill incorporated at the appropriate part of the mold, so as to cause the molten iron to solidify rapidly and produce a white rather than a grey iron structure.

Another method is to incorporate a tellurium-containing or bismuth-containing material as a coating on the mold. When this is done at some local point in the mold a thin layer of white iron structure is generally found to be produced in the region adjacent to the coating; this process has been used from time to time to increase local hardness or to improve the soundness of particular regions of a casting.

Another important use of molds coated with tellurium-based or bismuth-based materials has been for the purpose of producing small cast samples for thermal analysis. By coating the inside of the whole of the mold with a tellurium-containing material it is possible to obtain a casting that is of white iron structure throughout; when a thermocouple is placed in the centre of the sample and the cooling curve (temperature against time) during solidification is plotted, the temperatures at which the arrests occur allow the carbon equivalent and the carbon and silicon contents to be calculated; success depends, however, on the achievement of a substantially completely white iron structure.

When the iron used to make the sample has a fairly high carbon equivalent, or where the iron has been heavily inoculated with a graphitising substance, then the extent to which the tellurium coating on the mold is able to produce a white iron structure is reduced.

The aim of the invention is therefore to enhance the ability of a tellurium or similar (e.g. bismuth) coating on a mold to result in a white iron structure, especially in the presence of high carbon equivalents and/or heavy inoculation.

According to the invention this is achieved by including in the mold coating a material which contains water, either loosely combined as water of crystallisation, or in some other form, the water being combined strongly sufficiently to resist the normal drying of the mold but being able to be liberated at the temperature of the molten iron.

It will be appreciated that the use of free water, in the form of dampness, is out of the question because it would be turned to steam and cause serious rupture, but water loosely incorporated in a molecule such as that of a hydrated salt as water of crystallisation, will be liberated, when the molten iron comes into contact with the coating, in a sufficiently quiet manner to achieve the desired object without problems.

The inclusion of the water-bearing material in the coating may be carried out in a number of ways. For example it may be mixed with the tellurium- (or bismuth-) containing material and the resulting mixture is then applied to the mold. Alternatively the tellurium-containing substance may first be applied to the mold, followed by application of the water-containing material.

I have found that one way of applying the water-containing substance is to paint on to the surface of the mold a concentrated aqueous solution of the material to be added; another is to fill the mold with a concentrated solution of the material to be added, followed by draining off the excess solution. The mold is subsequently dried, for example by heating with a torch or in an oven. The substance to be chosen must be able to liberate water vapour in contact with molten cast iron at a rate which is not sufficient to cause violent reaction, and after the application of the material in the form of a solution it is important that the mold surface should be dried sufficiently to avoid a violent reaction occurring as the result of any dampness.

Requirements for a practicable coating include producing a fluid mixture of the constituents which contains a good dispersion of the materials mixed, which will adhere tightly to the surface to which it is applied without spalling, both after drying and during casting of the metal, and which will produce a coating which will not react violently when the molten metal is poured against it. Furthermore, the properties of the coating to be applied should be such that after drying the final coating thickness will lie preferably in the range from 10 to 40 thousands of an inch produced by either a single or multiple application of the coating.

The tellurium-containing material may be in the form of tellurium oxide and, where bismuth is used instead, this may be in the form of sodium bismuthate. Yet another possibility is to use a material containing tellurium and bismuth, for example sodium telluro-bismuthite.

It will be appreciated that it is impossible to provide an exhaustive list of those materials that will achieve the object of the invention. It is essential that the material should contain water and that the water should be capable of being retained (unlike free moisture) when the mold is dried at normal drying temperatures at least 100° C (for example 120° C) yet should be readily liberated at the temperature of the molten metal (say above 1200° C). This is true of many hydrated salts, where the water molecules are bound to the salt molecules as water of crystallisation.

Some examples of the use of water-containing materials in accordance with the invention, for producing white iron castings, will now be described.

Examples I to III show the use of sodium carbonate as the water-containing substance and Examples IV to VI show the use of calcium chloride. Each of these salts is obtainable in hydrated form. Sodium carbonate exists to some extent as the mono-hydrate, mainly as the deca-hydrate and, more rarely, as the hepta-hydrate. In the case of calcium chloride there are several hydrates but the only stable one is the hexa-hydrate. Calcium chloride is highly hygroscopic and retains some water even when heated.

In each of these six examples small thermal analysis shell-molded sand moulds 1¼ inches in dia. × 2 inches long were coated internally with a tellurium-containing mold coating. The molds were divided into pairs, and one (*b* in each case) of each pair was additionally coated with the hydrated salt, added by filling the mold with a saturated solution followed by draining out the excess liquid and drying in an oven at 105° C for 3 hours to remove all visible evidence of moisture. Each pair of molds was filled with molten grey cast iron containing 3.6 percent of carbon and 3.0 percent of silicon, which had been heavily inoculated and was poured at a temperature of approximately 1400° C. A thermocouple was placed in each mold and a cooling curve was recorded for each sample. From the cooling curve and estimate was made of whether a substantial amount of graphite was present in the sample. After solidification and cooling the samples were sectioned and examined microscopically to determine their structures. The results are recorded in the following table.

TABLE I

CHARACTERISTICS OF MOLDS COATED WITH TELLURIUM AND TELLURIUM WITH EITHER SODIUM CARBONATE OR CALCIUM CHLORIDE.

| Example No. | | Mold Coating | Characteristics of Cooling Curve* | Percentage of Graphite in Microstructure |
|---|---|---|---|---|
| I | a) | Tellurium | Grey | 95 |
| | b) | Tellurium + Sodium Carbonate | White | 0 |
| II | a) | Tellurium | Grey | 50 |
| | b) | Tellurium + Sodium Carbonate | White | 5 |
| III | a) | Tellurium | Grey | 15 |
| | b) | Tellurium + Sodium Carbonate | White | 5 |
| IV | a) | Tellurium | Grey | 95 |
| | b) | Tellurium + Calcium Chloride | White | 5 |
| V | a) | Tellurium | Grey | 20 |
| | b) | Tellurium + Calcium Chloride | White | 5 |
| VI | a) | Tellurium | Grey | 5 |
| | b) | Tellurium + Calcium Chloride | White | 0 |

*Grey Iron curves distinguished by recalescence behaviour.

From these results it is clear that although graphite contents up to 95 percent were obtained in the molds coated with tellurium-containing material alone, the amount of graphite in the samples cast into molds additionally treated with sodium carbonate or calcium chloride never exceeded 5 percent and the solidification behaviour of these latter samples was characteristic of a white cast iron, whereas the characteristics of the cooling curves for samples cast into molds treated only with tellurium-containing material were often characteristic of cast iron containing substantial amounts of graphite.

It will be understood that where we speak of coating a portion, or all, of the surface of the cavity of a mold we include within the phrase the possibility of coating not the female mold but part or all of an insert in that mold, for example of an inserted core.

I claim:

1. A method of making an iron casting containing at least a region of white iron comprising pouring molten iron into a mold having an internal surface of which at least a portion has first been coated with a material containing a white-iron-promoting material selected from the class consisting of tellurium and bismuth and compounds thereof and containing in addition a substance which contains water in a loosely chemically combined form, said water being bound sufficiently tightly to withstand drying of said mold but being liberated at the temperature of the molten iron.

2. The method set forth in claim 1 wherein said material and said substance are mixed together before being applied to said mold as a mixture.

3. The method set forth in claim 1 wherein said material is applied to the internal surface of said mold, followed by said substance.

4. The method set forth in claim 1 wherein said substance is a hydrated salt.

5. The method set forth in claim 4 wherein said substance is a hydrated sodium carbonate.

6. The method set forth in claim 4 wherein said substance is a hydrated calcium chloride.

7. A mold for making an iron casting containing at least a region of white iron, said mold comprising a body defining a mold cavity, at least a portion of the surface of said cavity being coated with a material containing a white-iron-promoting material selected from the class consisting of tellurium and bismuth and compounds thereof and containing in addition a substance which contains water in chemically loosely combined form, said water being bound sufficiently tightly to withstand drying of said mold but being such as to be liberated at the temperature of the molten iron.

8. The mold set forth in claim 7 wherein said substance is a hydrated salt.

9. The mold set forth in claim 8 wherein said substance is a hydrated sodium carbonate.

10. The mold set forth in claim 7 wherein said substance is a hydrated calcium chloride.

* * * * *